US006604754B1

(12) United States Patent
Gyr

(10) Patent No.: US 6,604,754 B1
(45) Date of Patent: Aug. 12, 2003

(54) INTEGRAL SUSPENSION SYSTEM FOR SKIS

(76) Inventor: Kaj Gyr, 1807 NE. 52nd Ave., Portland, OR (US) 97213

( * ) Notice: Subject to any disclaimer, the term of this patent is extended or adjusted under 35 U.S.C. 154(b) by 0 days.

(21) Appl. No.: 09/684,025

(22) Filed: Oct. 6, 2000

Related U.S. Application Data

(60) Provisional application No. 60/158,574, filed on Oct. 7, 1999.

(51) Int. Cl.[7] ..... A63C 5/07
(52) U.S. Cl. ..... 280/602; 280/607; 280/11.15
(58) Field of Search ..... 280/602, 601, 280/607, 610, 11.15, 809

(56) References Cited

U.S. PATENT DOCUMENTS 2,661,219 A * 12/1953 Coulson, Jr. ..... 280/11.13
3,260,532 A * 7/1966 Heuvel ..... 280/11.13
3,776,563 A * 12/1973 Tigert ..... 280/602
3,917,298 A * 11/1975 Haff ..... 280/607
4,139,214 A * 2/1979 Meyer ..... 280/607
4,696,487 A * 9/1987 Girard ..... 280/602
4,754,989 A * 7/1988 Hoelzl ..... 280/602
4,804,200 A * 2/1989 Kuchler ..... 280/602
4,896,895 A * 1/1990 Bettosini ..... 280/607
4,974,867 A * 12/1990 Rullier et al. ..... 280/607
4,979,761 A * 12/1990 Rohlin ..... 280/607
5,046,751 A * 9/1991 Scherubl ..... 280/607
5,129,668 A * 7/1992 Hecht ..... 280/607
5,647,605 A * 7/1997 Arduin ..... 280/602
5,671,939 A * 9/1997 Pineau ..... 280/602
5,758,894 A * 6/1998 Maggiolo ..... 280/602
5,775,716 A * 7/1998 Harsanyi et al. ..... 280/602
5,879,019 A * 3/1999 Mantel ..... 280/620
6,158,747 A * 12/2000 Magnani ..... 280/11.14

* cited by examiner

*Primary Examiner*—Brian L. Johnson
*Assistant Examiner*—Bridget Avery
(74) *Attorney, Agent, or Firm*—Kolisch Hartwell, P.C.

(57) ABSTRACT

A suspension system for skiis which incorporates a plurality of linkage mechanisms that control absorption dynamics. The linkage mechanisms couple a plurality of plates between the ski binding and the ski. A plurality of resilient elements are located between these plates to dampen impact forces and resiliently maintain spacing between the ski bindings and the ski. The linkage mechanisms may include unitarily constructed panels having flexural couplings or formed rod linkages. These linkage mechanisms constrain the lateral rotational motion of the plates relative to the ski, thus providing edge control concurrent with vertical movement. This allows for precise edge control and significant absorption of impacts and vibration. This device may be integral with the ski, or mounted on top of the ski. In either case, it is a mounting platform for the bindings.

7 Claims, 2 Drawing Sheets

INTEGRAL SUSPENSION SYSTEM FOR SKIS

CROSS REFERENCE TO RELATED APPLICATIONS

This application claims priority to U.S. Provisional Patent Application Serial No. 60/158,574 which is entitled INTEGRAL SUSPENSION SYSTEM FOR SKIS and was filed on Oct. 7, 1999.

FIELD OF THE INVENTION

This invention pertains to a full suspension system for skis which allows for total edge control, while significantly dampening impacts and vibration.

DESCRIPTION OF THE RELATED ART

Skiing is inherently dangerous and hard on the body. When skiing at any speed, regardless of terrain, the upper body is subjected to numerous jolts and impacts which the legs cannot effectively deal with. Such impacts engender fatigue in the skier, and create chatter and loss of contact with the snow. This alters performance significantly, and often culminates in physical injury.

Since impact force is the overall force divided by the time of force application, the ideal way to attenuate impact forces is by prolonging, and thereby lessening, the immediate force of impact. This is most efficiently done by allowing for "travel" anywhere between the ski and the upper body. The skier's legs do some of this work, but peak impact loads are more efficiently dampened somewhere between the binding and the boot, not via the skier's legs. A system which offers vertical travel concurrent with positive edge control is optimal.

Thus far all prior art shock absorbing elements for skis either do not provide positive edge control (by having mechanisms which allow for vertical travel, but poor control of lateral flexing), or do no more than dampen vibrations (by controlling lateral flexing but not allowing for vertical travel).

For example, U.S. Pat. No. 4,896,895 to Bettosini describes a plate of metal alloy sandwiched over a layer of absorbent material, and fastened to the ski. This approach allows for positive edge control, but doesn't offer the vertical travel necessary to truly absorb peak impact forces. In order for it to allow for positive edge control, said metal alloy plate must be very rigid both laterally and longitudinally. This has a negative affect on the natural flexing of the ski, creating a "flat spot" under the ski which drastically affects edge control. Even if this version was integrated into the ski a flat spot would ensue, as the longitudinal sheer forces exerted with ski flexing are not dampened appropriately by a top plate which is both rigid and adjacent to (as opposed to within) the ski's arc of flex. In addition, the attachment means are inherently subject to sticking when subjected to longitudinal sheer forces, thus affecting overall flexing of the plate in relation to the ski. There are a variety of other designs based on this approach which also do nothing to provide vertical travel, while suffering from the same drawbacks.

U.S. Pat. No. 4,139,214 to Meyer describes an articulating system based on a hinge positioned in front of the boot which allows for significant vertical travel, but unfortunately, also significant lateral rotational flexing. Correct transmission of lateral forces necessary for positive edge control is virtually impossible with such a system, as the front hinge is the only rigid transverse engagement with the ski. Torsional forces applied to the bindings thus engender lateral rotational flexing of the entire binding plate relative to the ski, significantly inhibiting positive edge control.

SUMMARY OF THE INVENTION

The present invention overcomes the deficiencies of the prior art by incorporating a plurality of linkage mechanism between the ski binding and the ski which effectively allow for optimum absorption of impact forces, while maximizing edge control. In this invention, upon impact, the top plate flexes vertically towards the ski, while maintaining lateral rigidity.

REFERENCE SYMBOLS IN DRAWINGS

2 Ski
4 Boot
6*a* Binding Toe
6*b* Binding Heel
8 Top Plate
10 Middle Plate
12 Ski Plate
14 Formed Rod Linkages
16 Panel Linkages
18 Substantially Rigid Body
20 Resilient Elements
22 Longitudinal Axes
24 Cylindrical Holes
26 Flexural Coupling
28*a* Formed Rod Flexure Axes (top)
28*b* Formed Rod Flexure Axes (bottom)
30*a* Panel Linkage Flexure Axes (top)
30*b* Panel Linkage Flexure Axes (bottom)
32 Replaceable elastomer cartridges
34 Primary Flexure axes
36 Secondary Flexure Axes
38 Tertiary Flexure Axes
40 Quaternary Flexure Axes

DESCRIPTION OF THE PREFERRED EMBODIMENTS

Figure 1:
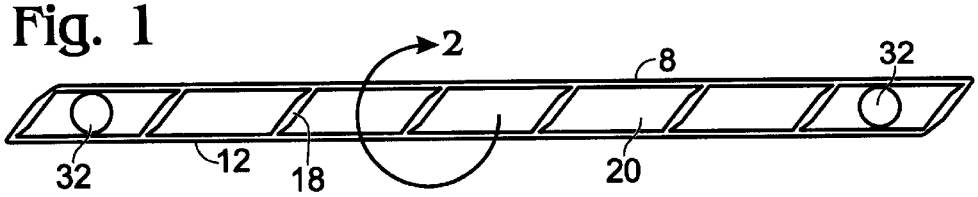
FIG. 1 is a side elevational view of a preferred embodiment of the invention.
Figure 2:
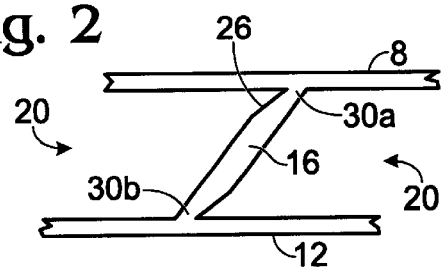
FIG. 2 is an enlarged view of the embodiment shown in FIG. 1 inside circle 2-2.
Figure 3:
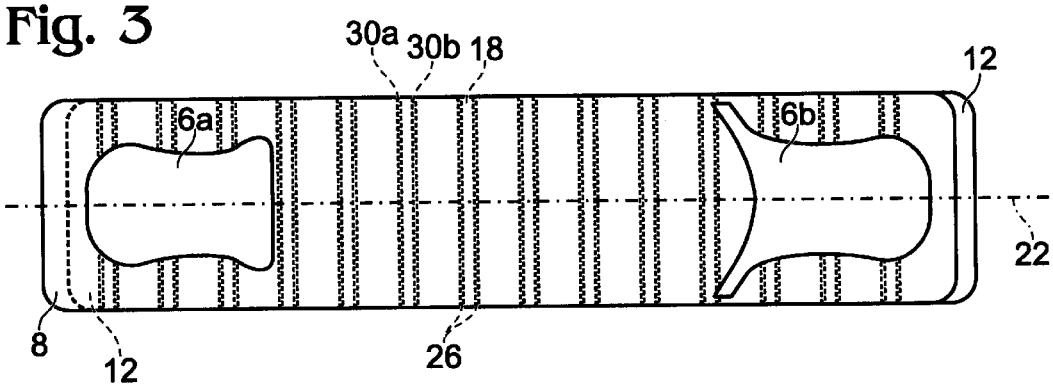
FIG. 3 is a top plan view of the embodiment of FIG. 1.

A first embodiment of the present invention is shown in FIGS. 1–3. Suspension system includes a top plate 8 coupled by a plurality of panel linkage mechanisms 30*a* and 30*b* (collectively, linkage mechanisms 30). A plurality of resilient elements 20 are located between the top plate 8, the ski plate 12, and panel linkage mechanisms 30. FIGS. 1–4 illustrate this type of panel linkage mechanisms. This design allows the top plate 8, linkage mechanisms 30, and ski plate 12 to be fabricated as a single body. The resulting panel linkages 16 have a substantially rigid body 18 and flexural couplings 26*a* and 26*b* (collectively 26) located at opposed margins of the rigid body 18 which are coupled to the top 8 and ski 12 plates. These flexural couplings 26 define flexure axis 30*a* and 30*b*, respectively, where the flexural couplings 26 couple to the top 8 and ski 12 plates. The flexural couplings 26 allow the respective plates, 8 and 12, to pivot about respective flexure axes 30*a*, 30*b*. Thus the top plate 8 pivots about the rigid body 18 of the panel linkages 16 along the flexure axes 30.

These flexible profiles may be molded, milled, extruded, or fabricated in any manner which allows for hinging motion of the rigid body 18 of the linkage mechanisms 16 via the flexural couplings 26. This dynamic hinging is known in the industry as a "living hinge". Plastics (generally of the softer variety such as UHMW, polypropylene, or Hytrel) are the preferred materials, but other materials may be suitable—essentially any material that provides low creep, good kinetic memory, pliability, and appropriate lateral rigidity suffice. Being that the flexural couplings are of lesser thickness than the rest of the shape, a hinging dynamic automatically occurs in this area. All other parts of the panel linkages 16 remain substantially unflexed via the rigid body 18.

As shown in FIGS. 1–6, the flexure axis 28, 30 of this embodiment are generally transverse to the longitudinal axis 22 (see FIG. 2). They may be spaced at varying intervals, but are preferably placed at around 1.5 inches apart. The vertical height of the panel linkages 16 may vary widely, but are generally preferable at around 0.4 inches.

Resilient elements 20 such as elastomers, gels, or air bladders (and various combinations thereof) may be incorporated in the present invention. The inside of the top plate 8 and ski plate 12 may be indented in order to allow for fore-aft rolling of relatively high durometer elastomer cylinders or spheroidal elastomers. If air bladders are used as the resilient elements 20, they may incorporate an integral valve such as those found on soccer balls, which allows for easy adjustment of pressure. Various degrees of bladder wall elasticity and inflation pressure can be used to customize the right performance characteristics for each skier depending on his/her weight, ski conditions, and ability. Open cell foam may be used inside the air bladders as a means of dampening.

If the resilient elements 20 are made from elastomer material, they may take the form of replaceable elastomer cartridges 32. This allows for infinite adjustment options, and insures that the damping quality is always optimal, insofar as when one elastomer is worn out, it is simply replaced.

The entire space between top 8, ski 12, and middle plate 10 should be filled with some kind of elastomer (or air bladder) not only to provide damping, but to keep snow from being packed into this area. As such, a relatively high density (shore oo of 60 of more) replaceable elastomer cartridge 32 can be used in conjunction with a relatively low-density resilient element (shore oo of 10–60). This allows for progressive damping, while still allowing for adjustability, and serving as a snow barrier.

FIG. 3 illustrates how the panel linkage 16 embodiment appears when mounted on skis with bindings. Although it's possible to have the panel linkages 16 run the entire length of the top 8 and ski 12 plates, it is not necessary. This illustration demonstrates how the panel linkages can be arranged in the forward portion (just under the binding toe 6*a*) and rear portion (just under the binding heel 6*b*). Such an arrangement allows for lighter weight, while retaining the same performance characteristics. The top plate 8 must connect the front and rear sections in either case, as shown. FIG. 3 illustrates how the ski plate 12 is actually integrated right into the ski, and is not removable.

Figure 4:
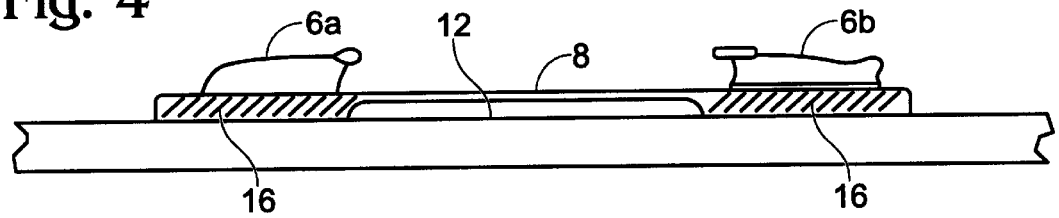
FIG. 4 is a side elevation view of the embodiment of FIG. 3 integral with a ski with bindings mounted.

FIG. 4 illustrates an alternative embodiment wherein two layers of panel linkages 16 are sandwiched together in mirror arrangement, such that upon compression the longitudinal movement of the top plate 8 and ski plate 12 are cancelled out by the opposite longitudinal motion of the middle plate 10. The top plate 8 is coupled to the middle plate 10 via panel linkages 16 and their respective flexural couplings 26, and the middle plate 10 is coupled to the ski plate 12 via panel linkages 16 which slant in the opposite direction. Therefore, in the embodiment illustrated in FIG. 4 top 8 and ski plates 12 would sheer to the right upon compression, and a middle plate 10 would sheer to the left an equivalent amount. This embodiment is a useful alternative in situations where longitudinal movement needs to be constrained.

The embodiment illustrated in FIG. 4 has a plurality of panel linkages 16 coupled to the top 8, middle 10, and ski plates 12 defining primary flexure axes 32 on the top plate 8, secondary flexure axes 36 on the middle plate 10, tertiary flexure axes 38 on the middle plate 10 and quaternary flexure axes 40 on the ski plate 12. Thus compressive forces applied to the top 8 and ski 12 (third) plates 12 compressibly move the top 8, middle 10 and ski 12 plates relative to each other while keeping the primary flexure axes 34 substantially parallel to the secondary flexure axes 36 and the secondary flexure axes 36 substantially parallel to the tertiary flexure axes 38 and the tertiary flexure axes 38 substantially parallel to the quaternary flexure axes 40 during compression. This drastically reduces impacts, while maintaining positive edge control and allowing for a net vertical movement while minimizing longitudinal sheer.

Figure 5:
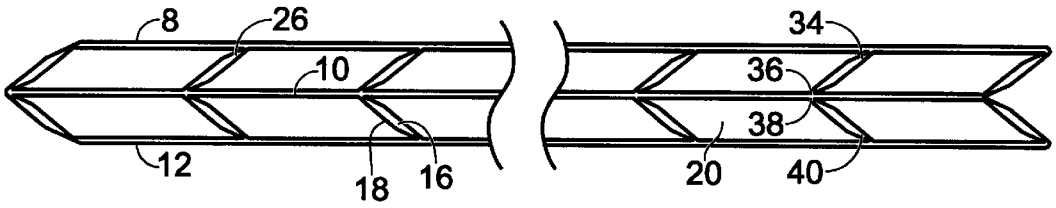
FIG. 5 is a side elevation view of an alternative embodiment of the present invention.

FIG. 5 illustrates another alternative embodiment of FIGS. 1–3, wherein formed rod linkages 14 take the place of panel linkages 16. The formed rod linkages 14 define flexure axis 28*a* on the top plate 8 and 28*b* on the ski plate 12. The plates move in relation to each other by pivoting on respective formed rod linkages 14. The flexure axes of this embodiment are collectively referred to as flexure axis 28. The top plate 8 and ski plate 12 have cylindrical holes 24 for receiving the formed rod linkages 14. The formed rod linkages 14 pass substantially transversely through the top plate 8 and ski plate 12 through these cylindrical holes 24, creating flexure axis 28 in a similar configuration to the first embodiment with panel linkages 16 pictured in FIG. 2. Thus the flexure axis 28 on the top plate 8 and ski plate 12 remain substantially parallel to one another as the plates move about the formed rod linkages 14.

The formed rod linkages 14 can be made out of any formed alloy rod or material of similar performance characteristics—even some molded plastics such as nylon would suffice. Preferably their diameter is 0.040–0.060 inches. Preferably the cylindrical holes 24 have an inner diameter of not more than 0.005 inches greater than the outer diameter of the formed rod linkages 14. Thus lateral rotational movement is minimized, maximizing edge control of the ski.

It's important for the top plate 8 and the ski plate 12 to be fairly rigid laterally, thus they should be made from a relatively high-strength plastic such as fiber-reinforced Nylon (and/or alloy, depending on desired performance characteristics). All three plates 8, 10,12 may be channeled, honeycombed, hollow in parts, even consist of multiple pieces—anything that allows for lightweight and adequate lateral rigidity (see example of altered shapes in FIG. 6). Anything which acts as a firm attachment for the linkages 14 is suitable. The preferred thickness range is 0.070–0.100 inches, depending on the diameter of the formed rod linkages 14 used.

There are a variety of methods for holding the formed rod linkages 14 laterally in place within the top plate 8 and ski plate 12. Preferably they would be insert molded into the top 8 and ski plates 12, but in lieu of that c-clips can be used, or the formed rod linkages 14 may simply be crimped on the ends.

Figure 6:
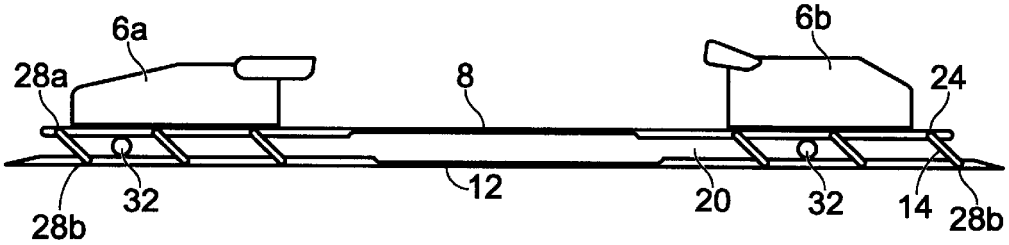
FIG. 6 is a side elevation view of an alternative embodiment of the present invention.
Figure 7:
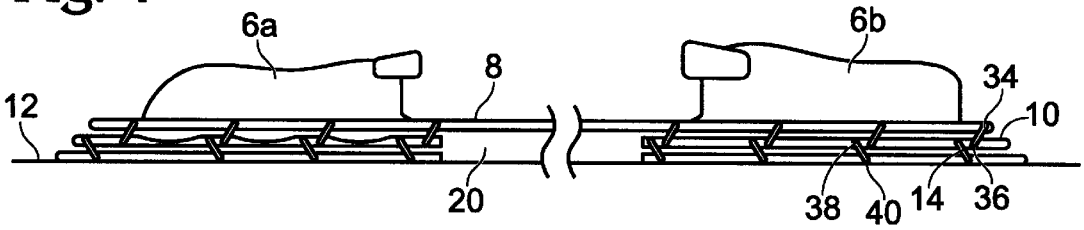
FIG. 7 is a side elevation view of an alternative embodiment of FIG. 6 integral with skis, with bindings attached.

FIG. 6 illustrates an elaboration of the alternative embodiment pictured in FIG. 5. As in FIG. 4, this version involves layering of linkages 14,16, except in this case the linkages are formed rod linkages 14. As in FIG. 3, FIG. 6 illustrates the elimination of linkages in the middle portion of this suspension system (between the binding toe 6*a* and the binding heel 6*b*).

Ideally all of the above embodiments of this suspension system are integrated into the ski in unitary construction (wherein the ski plate 12 is essentially the top portion of the ski and bonded accordingly). This is illustrated most clearly in FIG. 3. This allows for reduced weight, greater lateral rigidity, and a lower profile. As a less ideal alternative, a variety of fasteners can be used to attach this suspension system to a ski via the ski plate 12. These means include screws, gluing, various male-female type attachments, or rivets. If fasteners of any sort are used, there is very little need for any form of gasketing between the ski (as is imperative in U.S. Pat. No. 4,896,895 to Meyer) with the suspension system of this invention, as the ski plate 12 and top plate 8 are relatively flexible fore-aft, but torsionally rigid. In addition, the resilient elements 20 naturally sheer fore-aft when the ski is flexed. This relieves direct longitudinal pressure on the top plate 8, which allows for better performance of the ski and more "feel" for the terrain, as it promotes the natural flexing of the ski and negates any possibility for the "flat spot" encountered with Meyer et al.

Bindings are fastened onto the suspension system of this invention in conventional ways—either by drilling through the top plate 8 and fastening screws accordingly, or alternatively, having screwserts embedded into the top plate 8 which allow for ready attachment of given binding configurations. Any method which allows for a secure attachment will suffice.

As an alternative (or in addition) to using the resilient elements 20 for damping, the formed rod linkages 14 may actually double as torsion bars. This could be achieved by offsetting the flexure axis 28 a little from each other (on the longitudinal plane) so that a twisting dynamic would take place upon compression of the top plate 8, thus creating a dynamic which forces the top plate 8 and ski plates 12 apart—an effective spring. Damping of this spring action is still desirable through the use of resilient elements 20 such as elastomers, however.

Another way of providing for damping and spring action is to incorporate magnets, which by facing each other between the top plate 8 and ski plate 12, exert a repelling force which drives said plates away from each other, thereby effecting a springing action. This can be in conjunction with, or in addition to the aforementioned means for providing rebound and damping.

Linkages 14,16 may have their angles reversed, such that they collapse the other direction upon compression. This is largely a matter of individual preferences, skier's ability, and other performance characteristics of the ski.

This specification sets forth the best mode for carrying out the invention as known at the time of filing the patent application and provides sufficient information to enable a person skilled in the art to make and use the invention. The specification further describes materials, shapes, configurations and arrangements of parts for making and using the invention. However, it is intended that the scope of the invention shall be limited only by the language of the claims and the law of the land as pertains to valid U.S. patents.

I claim:

1. An integral suspension system for skis, comprising:

a first substantially rigid top plate;

a second substantially rigid middle plate;

a substantially rigid ski plate integral with a ski;

plural primary linkages coupled to the first and second substantially rigid plates, wherein the primary linkages define first flexure axes associated with the first plate and define second flexure axes associated with the second plate;

plural secondary linkages coupled to the second substantially rigid plate and the substantially rigid ski plate, wherein the secondary linkages define third flexure axes associated with the second plate and define fourth flexure axes associated with the ski plate, and wherein force applied to the first plate and the ski plate compressibly moves the first and second plates and the ski plate relative to each other and, during such application of force, the primary linkages maintain the first flexure axes substantially parallel to the secondary flexure axes, and the secondary linkages maintain the third flexure axes substantially parallel to the fourth flexure axes.

2. The integral suspension system of claim 1 wherein the linkages are panels extending substantially transversely across the first and second plates and the ski plate.

3. The integral suspension system of claim 1 wherein the linkages are formed rods.

4. An integral suspension system, comprising:

a first substantially rigid plate;

a second substantially rigid plate and a plurality of linkages that couple the first substantially rigid plate to the second substantially rigid plate such that compressive forces cause the two plates to move together in a substantially similar planar orientation; and a substantially rigid ski plate integral with a ski and a plurality of linkages connecting the ski plate to the second plate such that compressive forces cause the first plate and the ski plate to move together in substantially similar longitudinal and planar orientation.

5. The integral suspension system of claim 4 wherein the plates and the ski plate are of unitary construction with said linkages.

6. The integral suspension system of claim 4 wherein the linkages are panels extending substantially transversely across the plates.

7. The integral suspension system of claim 4 wherein the linkages are formed rods.

* * * * *